US006378428B1

(12) United States Patent
Schönberger

(10) Patent No.: US 6,378,428 B1
(45) Date of Patent: Apr. 30, 2002

(54) INK-METERING DEVICE IN A PRINTING PRESS

(75) Inventor: Wolfgang Schönberger, Neusass (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/299,242

(22) Filed: Apr. 23, 1999

(30) Foreign Application Priority Data

Apr. 23, 1998 (DE) ..... 198 18 129

(51) Int. Cl.[7] ..... B41F 31/04; B41F 31/06

(52) U.S. Cl. ..... 101/350.1; 101/365

(58) Field of Search ..... 101/148, 350.1, 101/350.6, 355, 360, 363–365, 367, 330, 331, 340, 344, 347, 315, 321, 326, 207, 208, 209, 210

(56) References Cited

U.S. PATENT DOCUMENTS

| | | | | |
|---|---|---|---|---|
| 3,318,329 A | | 5/1967 | Wintzer | |
| 4,242,958 A | * | 1/1981 | Jeschke | 101/365 |
| 4,729,312 A | | 3/1988 | Rodi et al. | |
| 5,408,929 A | | 4/1995 | Rodi | |
| 5,727,463 A | * | 3/1998 | Deschner et al. | 101/365 |
| 5,960,715 A | * | 10/1999 | Voge et al. | 101/365 |
| 6,012,389 A | * | 1/2000 | Roskosch et al. | 101/365 |

FOREIGN PATENT DOCUMENTS

| | | |
|---|---|---|
| DE | 27 11 553 | 9/1978 |
| DE | 35 38 256 A1 | 4/1987 |
| DE | 43 41 243 C2 | 6/1994 |
| GB | 1 560 160 | 1/1980 |

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

An ink-metering device in a printing press having a film disposed between an ink roller and metering elements associated with the ink roller, each of the metering elements having at least one support rib indirectly resting on the ink roller via the film, comprising low-wear zones provided on the film for covering the support ribs, the low-wear zones being formed as wirelike bodies joined to the film.

15 Claims, 6 Drawing Sheets

INK-METERING DEVICE IN A PRINTING PRESS

BACKGROUND OF THE INVENTION

Field of the Invention

The invention relates to an ink-metering device in a printing press having a film disposed between an ink roller and metering elements associated with the ink roller, each of the metering elements having at least one support rib indirectly resting on the ink roller via the film, the film having low-wear zones covering the support ribs.

In the published German Patent Document DE 43 41 243 C2, there is described a metering device of a printing press having a film with low-wear zones in the form of a metallized coating or a layer of carbon fiber-reinforced plastic material. This construction of the film represents considerable progress in the state of the art with respect to the service life thereof over films having no low-wear zones. It has been demonstrated, however, that the service life of such ink duct films, wherein the metal or carbon forming the low-wear zones is deposited in layers on the base material of the film and is, for example, vapor-deposited in multiple steps, is still unsatisfactory. On the one hand, the attainable layer thickness of the low-wear zones produced in this manner is very slight, so that, despite having an increased abrasion strength compared with that of the base material of the film, the low-wear zones are gradually ground down to the base material of the film by the rotating ink-duct roller within a given length of time that the film is in use. On the other hand, the attainable adhesion of the low-wear zones to the base material of the film produced in this manner is so slight that the low-wear zones break off in patches from the base material of the film. Both of these effects, which are dictated by the production process, cause the low-wear zones to lose the desired effect thereof in a comparatively short time and no longer retard the wear of the film overall.

In U.S. Pat. No. 3,318,239, a device with a three-layer ink duct lining is described which facilitates the cleaning of the ink duct. The ink duct includes a single ink knife but no metering elements. The ink duct lining has a thin, flexible vinyl layer, a tissue paper layer, and a cardboard layer, and has no low-wear zones.

SUMMARY OF THE INVENTION

It is an object of the invention to provide an ink-metering device in a printing press that assures reliable replicability of the metering setting.

With the foregoing and other objects in view, there is provided, in accordance with one aspect of the invention, an ink-metering device in a printing press having a film disposed between an ink roller and metering elements associated with the ink roller, each of the metering elements having at least one support rib indirectly resting on the ink roller via the film, comprising low-wear zones provided on the film for covering the support ribs, the low-wear zones being formed as wirelike bodies joined to the film.

In accordance with another feature of the invention, the film has a multilayered construction.

In accordance with a further feature of the invention, the film has a substrate layer and a filmlike securing layer, the wirelike bodies being secured on the substrate layer of the film by the securing layer of the film.

In accordance with an added feature of the invention, the film has a substrate layer and a securing layer, the wirelike bodies being secured on the substrate layer of the film by the securing layer, the securing layer being pourable into spaces between the wirelike bodies.

In accordance with an additional feature of the invention, the wirelike bodies are embedded in solidifiable material forming the film.

In accordance with yet a further feature of the invention, the wirelike bodies have a curved contoured profile.

In accordance with another aspect of the invention, there is provided an ink-metering device in a printing press having a film disposed between an ink roller and metering elements associated with the ink roller, each of the metering elements having at least one support rib indirectly resting on the ink roller via the film, comprising a plurality of low-wear zones provided on the film for covering the support ribs, the plurality of low-wear zones being disposed so that a zonal spacing between adjacent low-wear zones is less than a total width that includes two support widths of adjacent support ribs.

In accordance with a further aspect of the invention, there is provided an ink-metering device in a printing press having a film disposed between an ink roller and metering elements associated with the ink roller, each of the metering elements having at least one support rib indirectly resting on the ink roller via the film, comprising a plurality of low-wear zones provided on the film for covering the support ribs, the plurality of low-wear zones covering a support width of one and the same support rib.

In accordance with another feature of the invention, the support width of the support rib is at least as large as a center-to-center spacing between two adjacent low-wear zones.

In accordance with a further feature of the invention, all of the low-wear zones of the film are disposed at an identical spacing from one another.

In accordance with a concomitant aspect of the invention, there is provided a printing press having at least one ink-metering device with at least one of the foregoing features.

The service life of an elastic film formed in the foregoing defined manner is very long, and abrasion from the low-wear zones in the region of contact with the ink roller is very slight. Thus, high replicability of the setting or adjustment of the relative position of the metering elements to the circumferential surface of the ink roller and of the amount of ink allowed to pass through the metering elements on the circumferential surface of the ink roller is assured.

A setting or adjustment of the metering elements that is memorized electronically or noted in writing and that corresponds to a printed image of a printing job can be re-used, in a repeat job that has the same particular printed image without requiring correction as in corresponding devices of the prior art. The wirelike bodies that form the low-wear zones may be formed of metal, metal alloy, plastic material, or some other abrasion-proof material. The wirelike bodies can be joined to the film by being embedded in the film or secured to the film.

The film may be embodied in multiple layers. The multilayer film can have various types of film layers. For example, a first film layer may perform a function that stabilizes the film, while a second film layer may perform a function enabling the integration of the wirelike bodies with the film. The wirelike bodies may also be enclosed between two identical film layers of the multilayer film. Preferably, one of a plurality of film layers is a securing layer for joining the wirelike bodies to the film.

In a further embodiment, the wirelike bodies are secured on a substrate layer of the film with a film-like securing layer of the film. By forming the film of at least two mutually joined film-like film layers, advantages in terms of production technology are attained. For example, the film layers can be adhesively joined or welded together, enclosing the wirelike bodies therebetween. The wirelike bodies themselves may be firmly joined to a single one of the film layers or to both film layers. Provision may also be made for the wirelike bodies themselves not to be firmly joined to the film layers and, for example, to be placed loosely between the film layers; the wirelike bodies may then held in the securing position by form-locking engagement with the film layers. In this regard, it is noted that a form-locking connection connects two elements together due to the shape of the elements themselves, as opposed to a force-locking connection, that locks the elements together by force external to the elements.

In a further embodiment, the wirelike bodies are secured on a substrate layer of the film with a securing layer of the film, which can be poured in between the wirelike bodies. In this embodiment as well, there are technological advantages in the production of the film. For example, the wirelike bodies can be placed on a film-like substrate layer or joined loosely to the substrate layer and, thereafter, a fluid or liquid, paste-like, powdered or granular filling material can be poured into the interstices between the wirelike bodies, to serve as the securing layer. The securing layer, which hardens firmly, joins the wirelike bodies to the substrate layer.

In a further embodiment, the wirelike bodies are joined to the film by being embedded in solidifiable material forming the film. This embodiment, just like the embodiments described hereinbefore, is distinguished by the fact that the wirelike bodies have an especially firm hold on the substrate layer. The solidification can be thermally, for example, by The wirelike bodies, in the production of the film from a fluid or liquid, paste-like, powdered or granular film material, can be placed in this film material, for example, and, after solidification of the film material, the wirelike bodies are firmly joined to the film.

In a further embodiment, the wirelike bodies have a curved-contoured profile. The advantage of this embodiment is that the film can be made using commercially available metal wires or plastic filaments as the wirelike bodies. Such wires or filaments as a rule have a circular cross section.

In a further embodiment, the plurality of low-wear zones formed as wirelike bodies are disposed so that a zonal spacing between respective pairs of mutually adjacent low-wear zones is less than a total width that includes two widths of adjacent support ribs. Such an arrangement of the low-wear zones relative to the dimensioning of the support ribs of the metering elements is possible, and inventive per se, not only in conjunction with low-wear zones embodied as wirelike bodies but also in conjunction with conventional low-wear zones of a corresponding ink-metering device in the prior art. In this manner, very good replicability of the metering setting or adjustment of metering elements is attained, each of the metering elements having two support ribs and a recess forming a metering gap, that is located between the support ribs. As a rule, the metering elements, which are arranged in a row, are disposed so close together than even if at least one of two support ribs is covered by a low-wear zone, tilting of the metering element is practically precluded.

In a further embodiment, the low-wear zones are disposed so that more than one of the low-wear zones at a time cover a support width of one and the same support rib. This embodiment is especially highly suitable both for metering elements having only a single support rib and for metering elements, respectively, having two support ribs. In the case of the metering elements with two support ribs, assurance is provided that each of both support ribs is covered at all times by a plurality of low-wear zones. With the latter embodiment, in which both support ribs, respectively, of a metering element are always covered by at least two low-wear zones at a time, a tilting motion of the metering element is absolutely reliably prevented, even if the gap between this metering element and an adjacent metering element allows a slight tilting motion.

In a further embodiment, the support width of the support rib is at least as large as a center-to-center spacing between two adjacent low-wear zones. This embodiment is especially advantageous in the case of low-wear zones embodied as wirelike bodies with a curved contoured profile, such as wires with a circular profile. Low-wear zones embodied in this manner are very reliably prevented from being displaced laterally away through the support rib by the pressure acting thereon. The center-to-center spacing of respective pairs of mutually adjacent low-wear zones is precisely equal to or less than the support width of a single one of the support ribs associated with the two low-wear zones. In the case wherein the two adjacent low-wear zones are associated with two adjoining support ribs of two adjacent metering elements, provision may be made for the center-to-center spacing of the two adjacent low-wear zones to be precisely equal to or less than the total width of the two immediately adjacent support ribs.

In a further embodiment, all of the low-wear zones of the film are disposed with identical spacing from one another. Preferably, all of the low-wear zones of the film are disposed with the same center-to-center spacing from one another. The spacings of respective adjacent low-wear zones from one another are thus constant not only locally in the region of the support ribs but also over the entire width of the film in the axial direction of the ink roller. This embodiment is advantageous with regard to manufacturing the film material. For example, when the film is cut to the size of an ink duct width, it is no longer necessary to devote any time for providing a correct association of the low-wear zones with the support ribs of the metering elements. Straightening of the film, so that low-wear zones grouped locally in the region of the support ribs are pushed into coincidence with the support ribs, is thus no longer necessary.

The invention can be employed in rotary printing presses which use direct or indirect planographic or letterpress printing. For example, the invention can be used in web-fed or sheet-fed offset printing presses. The ink roller is preferably the ink duct roller, belonging to an ink duct, of a vibrator-type or continuous-feed inking unit of the printing press.

Other features which are considered as characteristic for the invention are set forth in the appended claims.

Although the invention is illustrated and described herein as embodied in an ink-metering device in a printing press, it is nevertheless not intended to be limited to the details shown, since various modifications and changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
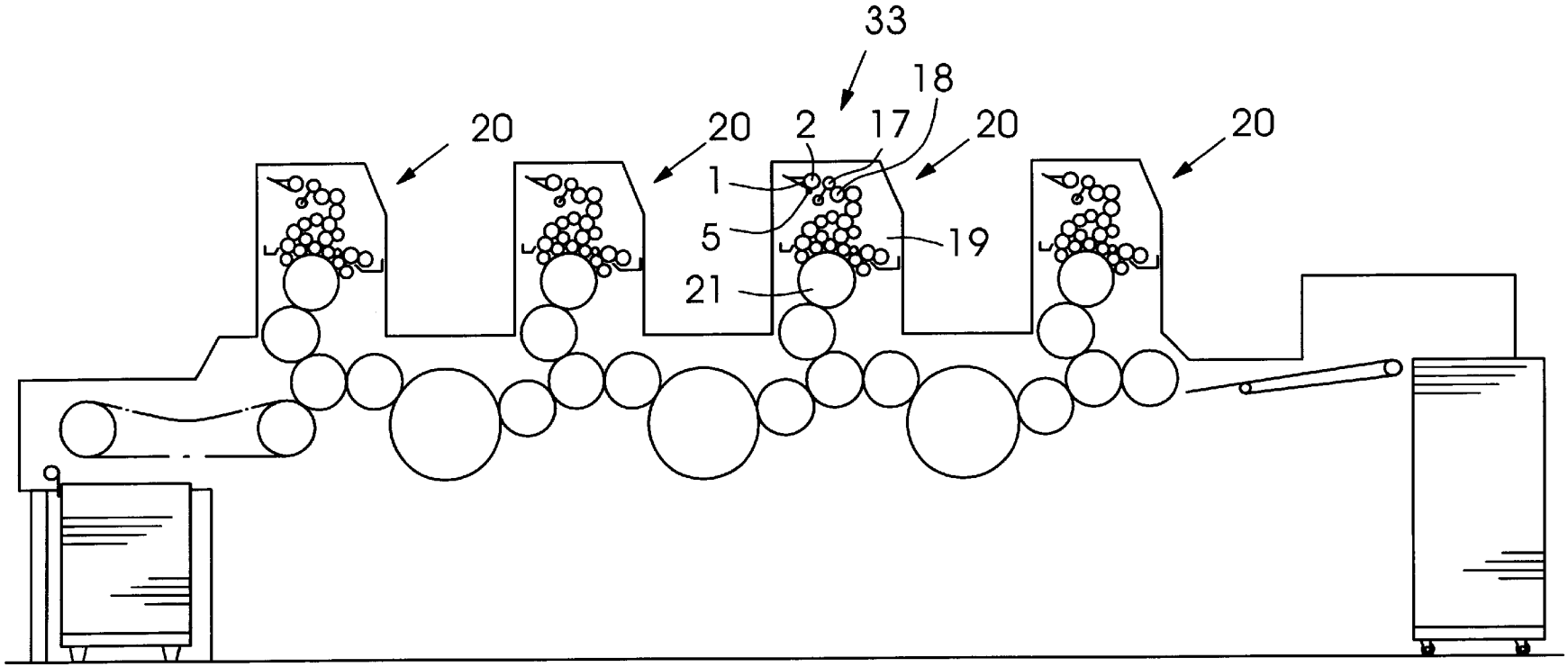
FIG. 1 is a diagrammatic side elevational view of a printing press incorporating at least one ink-metering device according to the invention.

Referring now to the drawings and, first, particularly to FIG. 1 thereof, there is shown therein a sheet-printing rotary printing press 33 employing the offset printing process and having a plurality of printing units 20 for multicolor printing. Each printing unit 20 includes a printing-form cylinder 21 with a printing form having a printing image that is transferred to printing material or stock. Inking of the printing form on the printing-form cylinder 21 is performed by an inking unit 19, that includes ink or inking rollers 2, 17 and 18. The ink roller 2 is an ink duct roller belonging to an ink duct 1, printing ink being transferred from the roller 2 by the ink roller 17 to the ink roller 18. The ink roller 17 is embodied as a vibrator roller reciprocatingly oscillating between the ink roller 2 and the ink roller 18, and the ink roller 18 is embodied as a distributor roller displaceable reciprocatingly in the axial direction thereof. A metering device 5 assigned to the ink roller 2 is disposed on the ink duct 1.

Figure 2:
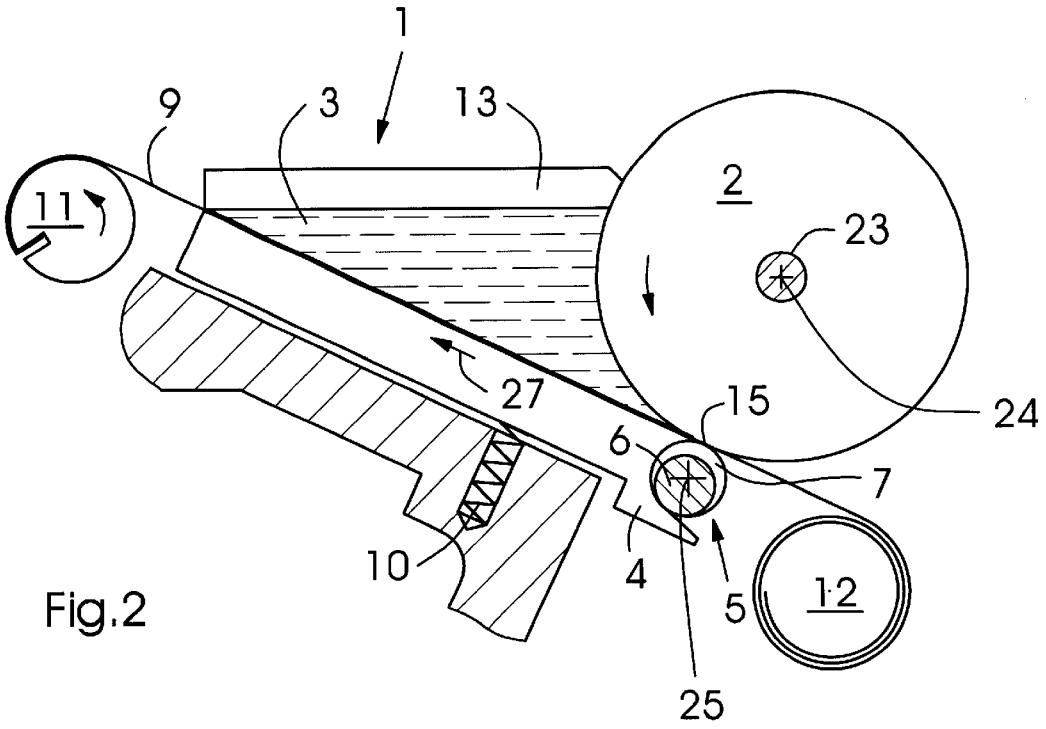
FIG. 2 is an enlarged fragmentary diagrammatic side elevational view of FIG. 1, showing an ink-metering device according to the invention associated with an ink roller of the printing press.
Figure 3:
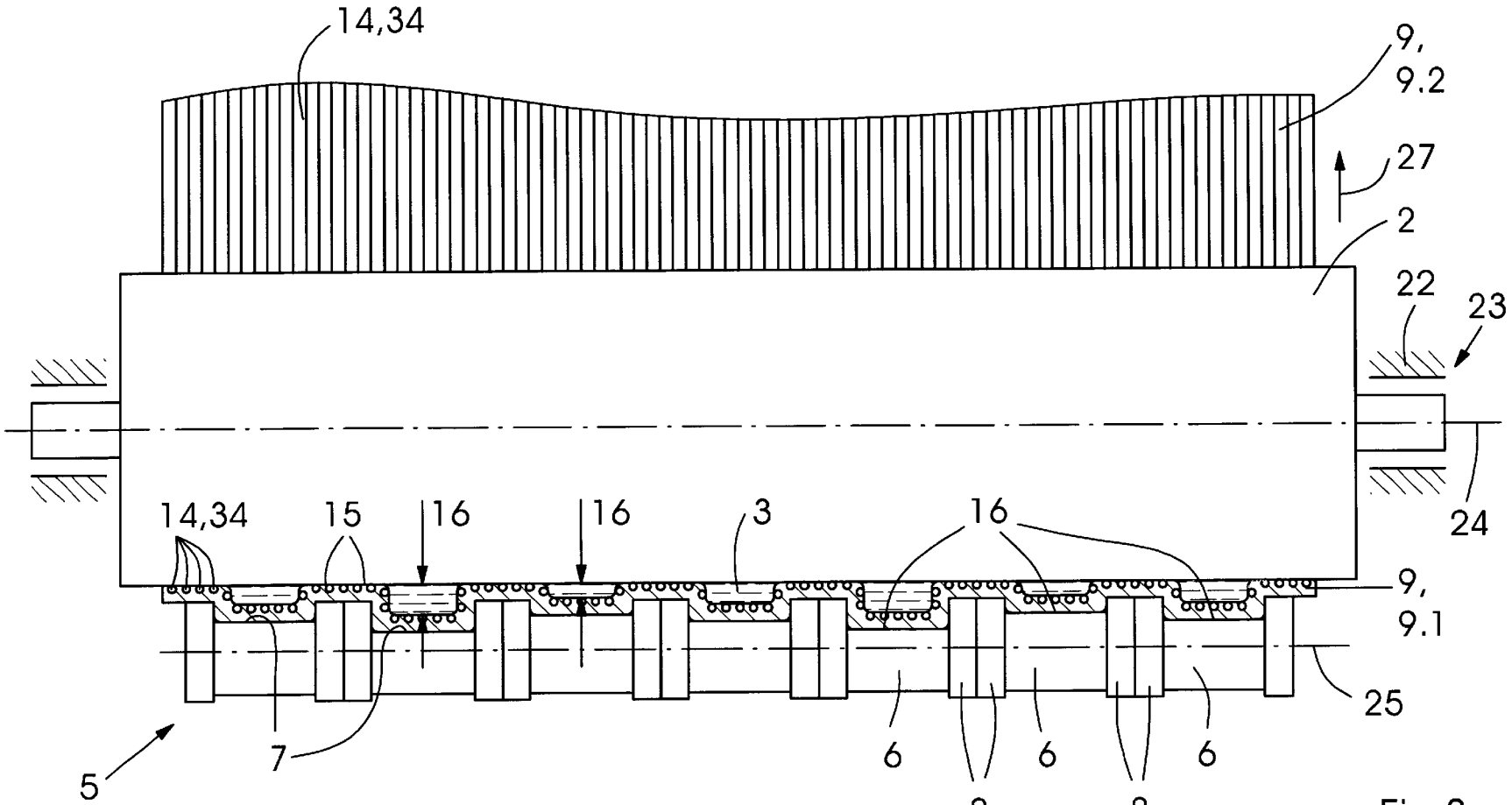
FIG. 3 is a diagrammatic front elevational view of the ink metering device as seen from the right-hand side of FIG. 2.

The ink duct 1 of FIG. 1 is shown in greater detail in FIG. 2. The ink duct 1 is defined by the ink roller 2 and by laterally disposed side jaws 13. The bottom of the ink duct 1 is formed by a contact-pressure strip 4. An elastic film 9 wound on two spools 11 and 12 extends from one of the spools 11 and 12 to the other and is disposed between the contact-pressure strip 4 and an ink supply 3 in the ink duct 1. Via a compression spring 10, the contact-pressure strip 4 is pressed from below against the elastic film 9. A metering device 5 for metering the printing ink 3 is disposed on the lower end of the contact-pressure strip 4. The ink duct 1 with the metering device 5 having metering elements 6 which are adjustable to zonally varying ink gap thicknesses and to variable spacing relative to the ink roller 2, so that the respective spacing thereof from the ink roller 2, together with the film 9 that has a given thickness, determines the ink gap 16 in this metering region, is distinguished by the fact that each zone-wide metering element 6 has side by side, in the axial direction of the ink roller 2, at least one support region and one metering region, preferably a recessed metering region enclosed by two lateral support regions. The support regions of the metering elements 6 are embodied as support ribs 8, as shown in FIG. 3, projecting towards the ink roller 2 either a single support rib 8 or a plurality thereof, preferably two, being provided per metering element 6. The recess 7 forming the inking and metering gap 16 (FIG. 3) is located between the support ribs 8. The recess 7 may be located between the support ribs 8 of two adjacent metering elements 6, and/or preferably between the support ribs 8 each of a single metering element 6. The metering elements 6 constantly and indirectly contact the ink roller 2 by the support ribs 8, individually and independently of one another, under spring pressure, and the recesses 7 have a wedge-like course. The recesses 7 are formed adjacent to the one or more narrow support ribs 8 as eccentric indents or taps provided in the cylindrical metering elements 6 which are rotatable in the circumferential direction. The metering elements 6 are covered by the film 9, a supply of which is wound on a supply spool or coil 12 that can also be secured to the ink duct 1. The film 9 is pressed at contact locations 15 by the metering elements 6 against the ink roller 2 and, as a result, the film 9 is subject to severe mechanical stress.

In FIG. 3. the ink-metering device according to the invention, that is shown in a side elevational view in FIG. 2, is shown in a front elevational view. In the interest of providing a better view of the contact locations 15, the film 9 is shown in section, and the spool or coil 12 has been omitted. The metering elements 6 are disposed close to one another over the width of the ink duct 1, that is also not illustrated in FIG. 3. Each of the metering elements 6 is formed with the recess 7, by the rotary position of which relative to the ink roller 2, the flow of ink through the ink gap 16, formed between the ink roller 2 and the respective metering element 6, is defined. The metering elements 6 are rotatable about the pivot axis 25 thereof and can be rotated individually either manually or via control motors, respectively, assignable to each of the metering elements 6. Eccentric recesses 7 extending in the form of annular grooves over a portion of the circumference of the metering elements 6, are provided on the individual metering elements 6. The respective recess 7 of each metering element 6 is defined by a pair of respective support ribs 8. When the ink roller 2 rotates, the regions of the film 9 contacting the ink roller 2, namely the low-wear zones 14 of the film 9 that cover the region of the support ribs 8, are subject to severe mechanical stress. The low-wear zones 14 formed as wire-like bodies 34 extend, in the longitudinal direction thereof, perpendicularly to the axial direction of the ink roller 2. The low-wear zones 14 are located on the side of the film 9 facing towards the ink roller 2 and form part of the surface of this side of the film 9. In the region of the contact location 15, the low-wear zones 14 extend tangentially to the ink roller 2. The film 9 is elastic in the axial direction of the ink roller 2, so that the flexible film 9 can conform to any possible position of the recesses 7. The low-wear zones 14 contacting the ink roller 2 are not subject to any abrasion or are subject to only very slight abrasion, so that no material change in spacing between the support ribs 8 of the metering elements 6 and the ink roller 2 can be caused by any decrease in film thickness in the region of the contact locations 15, and the thickness of the ink gap 16, once set in a precisely defined manner, remains constant per metering element 6. In FIG. 3, the zonally different widths of the opening of the ink gaps 16 of the metering elements 6 are shown. The low-wear zones 14 are formed as wirelike bodies 34 extending parallel to one another and spaced-apart mutually equal distances from one another in the axial direction of the ink roller 2 over the entire width of the film 9. In the case of a film 9 that is windable onto a spool (FIG. 2), the wirelike bodies 34 are correspondingly deformable in the longitudinal direction thereof. By arranging the wirelike bodies 34 with a spacing AZ, MZ or IZ (FIG. 5) from one another, the abrasion properties of the film 9 are improved in locally limited areas, without negatively affecting the elastic properties of the remaining film regions, in particular, the transverse elasticity of the film 9.

Figure 4:
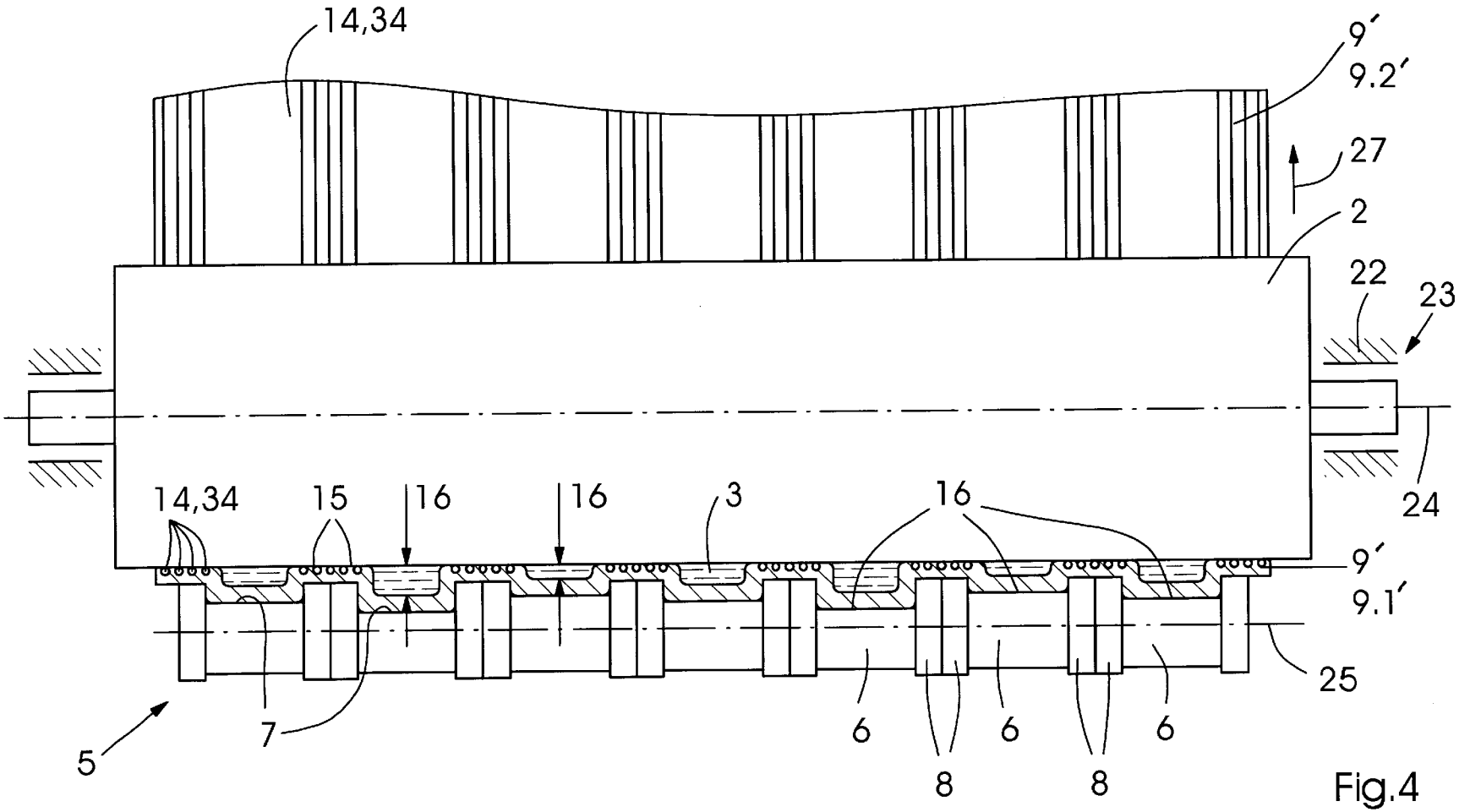
FIG. 4 is a view like that of FIG. 3 of the ink-metering device shown in FIGS. 1–3 except the film has a different construction.

In FIG. 4, an embodiment of an ink-metering device according to the invention is shown that differs from the device illustrated in FIG. 3 solely in that the film 9' has a different construction. Whereas in the film 9 shown in FIG. 3, the low-wear zones 14 extending longitudinally of the film 9 are distributed uniformly over the full width thereof, in the case of the film 9' shown with the cross section 9.1' thereof in FIG. 4, the concentration of low-wear zones 14 is variable over the width of the film. It is believed to be readily apparent from the cross-sectional view 9.1' of the film 9' that the low-wear zones 14 are concentrated at locations of the film 9 which correspond to the arrangement of the support ribs 8. Each support rib 8 is covered by a plurality of low-wear zones 14. In the region of the recesses 7 between the support ribs 8, either no low-wear zones 14 or fewer low-wear zones 14 than in the region of the support ribs 8 may be provided. The uneven distribution of low-wear zones 14 over the film width is apparent from the plan view on the film portion 9.2'. The low-wear zones 14 extend parallel to one another longitudinally of the film 9' and form strip-like zone groups corresponding to the support ribs 8. The low-wear zones 14 of each group of zones are disposed at a like spacing AZ, MZ or IZ (FIG. 5) from one another, and each group of zones includes a like number of low-wear zones 14. Both in the embodiment of the ink-metering device shown in FIG. 3 and of the ink-metering device shown in FIG. 4, it is possible to see through to the film portion 9.2' disposed in the ink duct 1, because the ink 3 provided in the ink duct has not been shown in these figures and, in the interest of greater simplicity, the contact-pressure strips 4 with the contact-pressure springs 10, the spool 11 and the side jaws 13 have also not been illustrated. In the embodiment of the ink-metering device shown in FIG. 4, as well, the low-wear zones 14 are formed as wirelike bodies 34 joined to the film 9' and making up part of the surface of the film 9' facing towards the ink roller 2.

Figure 5:
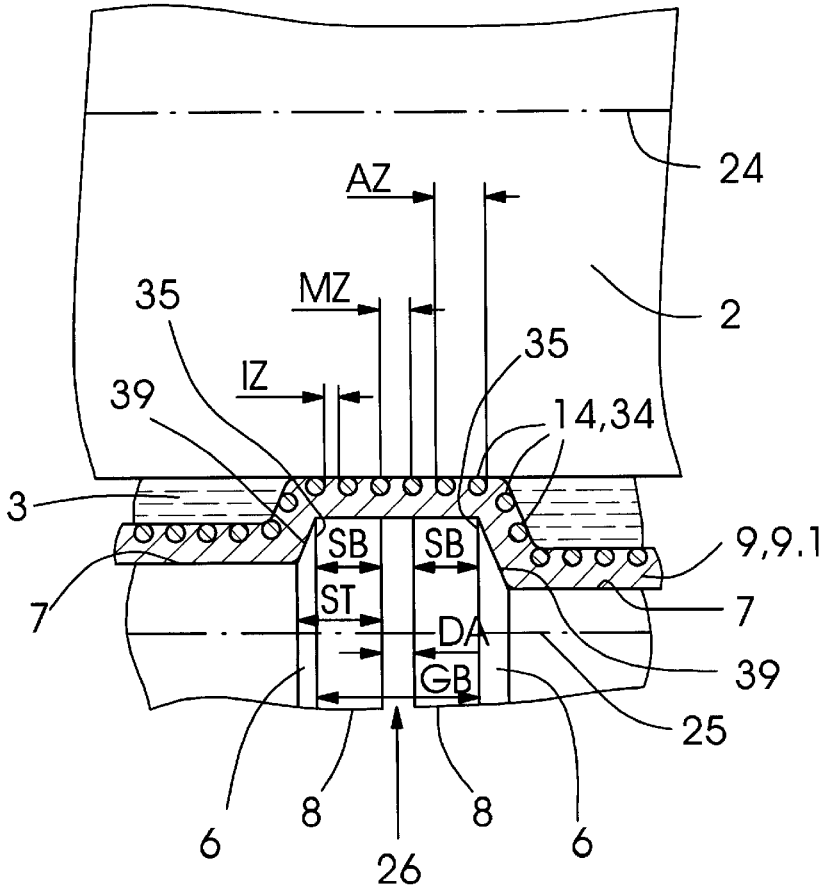
FIG. 5 is an enlarged fragmentary view of FIG. 3, showing in detail the association of the low-wear zones with the support ribs in accordance with the invention.
Figure 6:
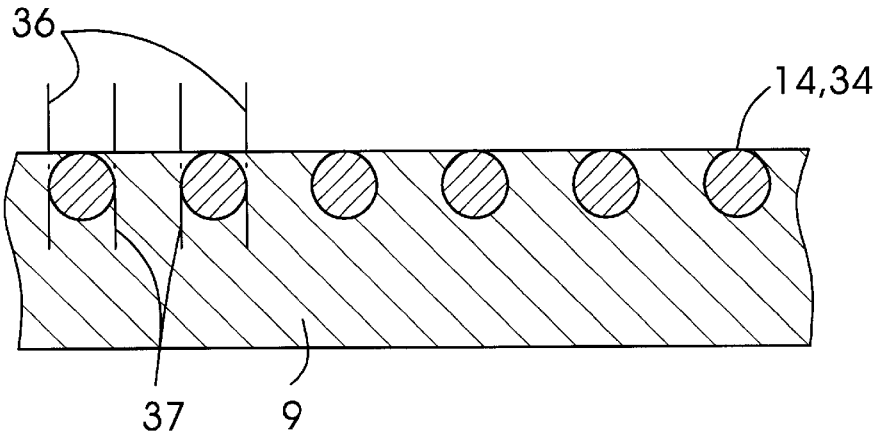
FIG. 6 is a much-enlarged sectional view of a preferred embodiment of the film shown in one of the foregoing FIGS. 2 to 5.
Figure 7:
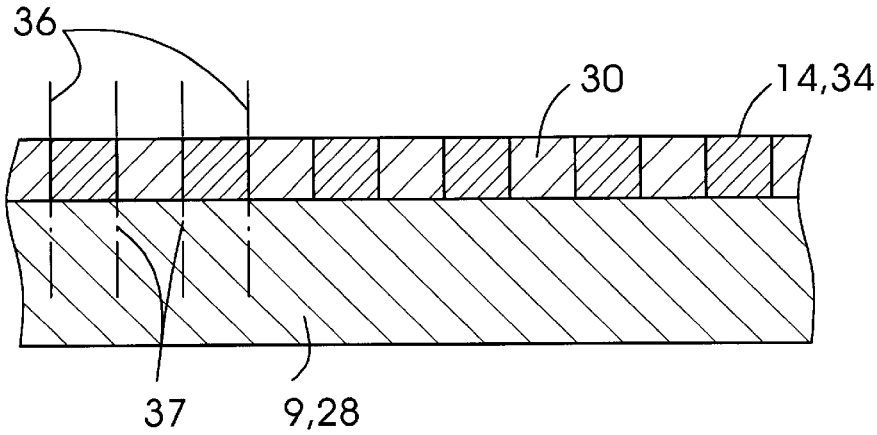
FIG. 7 is a view like that of FIG. 6 of another preferred embodiment of the film.
Figure 10:
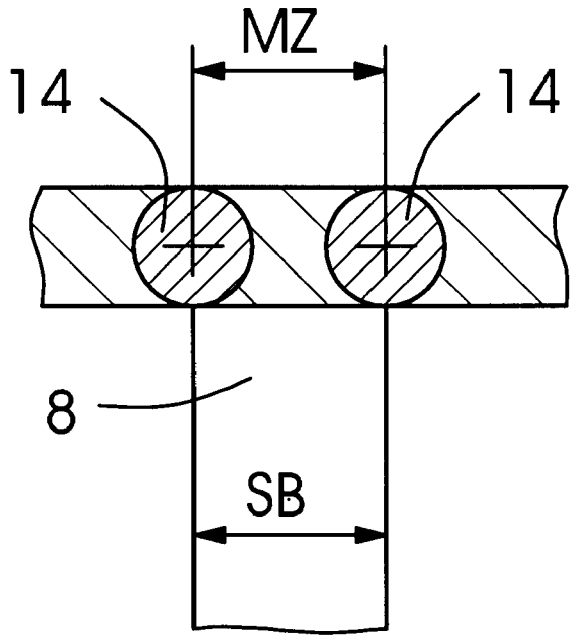
FIG. 10 is an enlarged fragmentary sectional view of FIG. 6, showing low-wear zones at a preferred spacing from one another.
Figure 11:
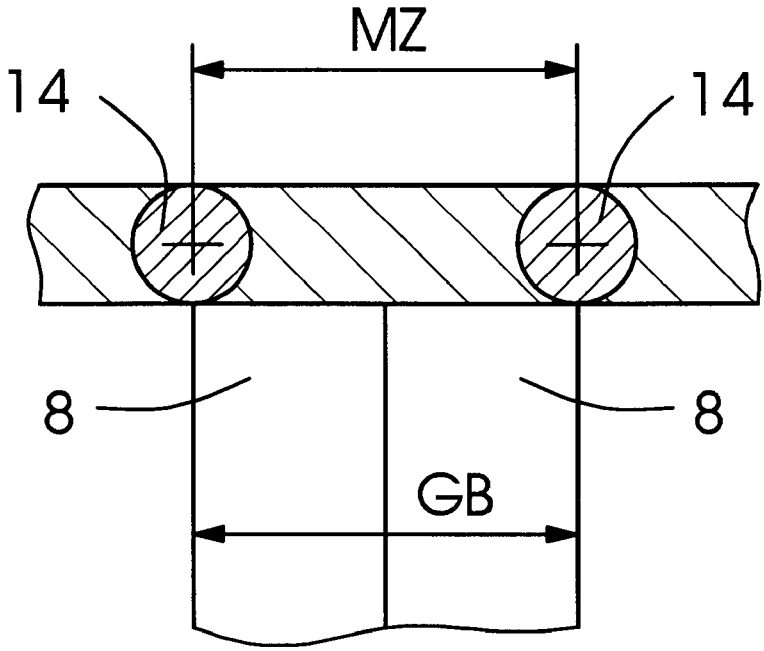
FIG. 11 is a view like that of FIG. 10, showing the low-wear zones at a different preferred spacing from one another.

In FIG. 5, a preferred arrangement of the low-wear zones 14 with respect to the support ribs 8, for example, for the embodiment of the film 9 of FIG. 3, is illustrated. The preferred arrangement of low-wear zones 14 in the region of the support ribs 8 can be adopted without changing the embodiments of the films, respectively, shown in FIG. 4 and, hereinafter, in FIGS. 6 to 9. In FIG. 5, the gap 26 covered by the film 9 is shown between the immediately adjacent metering elements 6, with a metering element spacing DA represented exaggeratedly large in the interest of providing a better illustration. The metering elements 6, as a rule, have very smooth side faces facing towards one another and disposed very close together, so that the metering element spacing DA, in most cases, is negligibly small. The metering elements 6 shown in FIG. 5 have support ribs 8, respectively, formed with a bevel or chamfer 39 defining the recess 7. In this case, the effective support width SB is not equivalent to the total rib width ST. In metering elements 6 having a defined rectangular recess 7, instead of the trapezoidal recess 7 shown in FIG. 5, the effective support width SB may correspond to the total support width SB. The total width GB is the sum of the two effective support widths SB of the adjacent metering elements 6 and the existing metering element spacing DA therebetween. The total width GB is practically twice the support width SB. If the chamfer 39 is omitted, the total width GB is then practically equal to twice the rib width ST. The effective support width SB of each support rib 8, which may be from 1 to 3 mm, for example, is covered by a plurality of low-wear zones 14. The low-wear zones 14 are arranged relative to one another so that the inside spacing IZ or the center spacing MZ or outside spacing AZ of respective pairs of immediately adjacent low-wear zones 14 from one another is less than twice the size of the effective support width SB and less than the total width GB, respectively. The support width SB of each support rib 8 is preferably precisely equal to or greater than the center spacing MZ of the at least two adjacent low-wear zones 14 in the region of the film 9 wherein the respective support rib 8 is braced (FIG. 11). The respective two adjacent low-wear zones 14 have two zone boundaries 36, facing away from one another, and two zone boundaries 37, facing towards one another (FIGS. 6 and 7). For example, the zone boundaries 36 and 37, in the case of thin layers applied by vapor deposition onto the film 9 in the form of the low-wear zones 14, can be formed by side edges of the thin layers. In the preferred embodiment of the low-wear zones 14 formed as wirelike bodies 34, the mutually closest contour locations of the low-wear zones 14 and 34 inside a transverse or cross-sectional plane form inner zone boundaries 37, and the mutually farthest-apart contour locations inside the transverse or cross-sectional plane form outer zone boundaries 36. The measure between the inner zone boundaries 37 is the inside spacing IZ, and the measure between the outer zone boundaries 36 is the outside spacing AZ. The center spacing MZ characterizes the measure by which the low-wear zones 14 are offset from one another. For the low-wear zones 14 shown in FIG. 5 and embodied as wirelike bodies 34, the center spacing MZ is referred to the center points of the cross sections, which are circular, for example. In the embodiment of the low-wear zones 14 formed as wirelike bodies 34 of identical cross section, which are shown in FIG. 7, the center spacing MZ corresponds to the measure between the outer zone boundary 36 of a first low-wear zone 14 and the inner zone boundary 37 of the second low-wear zone 14 adjacent to the first low-wear zone 14. It is advantageous if each support rib 8 is braced against the ink roller 2 via at least two low-wear zones 14. The center spacing MZ of two adjacent low-wear zones 14 is preferably precisely equal to or less than the support width SB of the support rib 8 (FIG. 10). In this case, the proportionate coverage of the two adjacent low-wear zones 14 covering the support width SB is at least equivalent to the maximum possible proportionate coverage of a single low-wear zone 14. An absolutely nontilting contact of the metering elements 6 with the ink roller 2 indirectly via the low-wear zones 14 is attained if the outside spacing AZ of two adjacent low-wear zones 14 is precisely equal to or less than the support width SB of the support rib 8. Preferably, all the adjacent low-wear zones 14 of the film 9 are spaced apart with the same spacing MZ and thus also with the same spacings AZ and IZ from one another. By embodying the film 9 with low-wear zones 14 which are disposed at a constant spacing from one another over the full width of the film, the adaptation of the film 9 to different widths of ink duct is facilitated. In such a case, when the film 9 is cut to the respective ink duct width, it is unnecessary to devote any time for making sure that the low-wear zones 14 correspond to the support ribs 8, because such a condition will always occur spontaneously.

In FIG. 6, a preferred embodiment of the film 9 with low-wear zones 14 embodied as wirelike bodies 34 is shown. The wirelike bodies 34 are formed of abrasion-proof material, such as metal or plastic material, and are embedded in the elastic base material of the film 9. The film 9 can be produced, for example, with the wirelike bodies 34 forming a skeleton, over which the base material is poured in a liquid state, the wirelike bodies 34 being firmly joined to the film 9 after the solidifiable base material has set, for example, as a consequence of having been cooled down. This is a production method especially suitable for films formed of plastic material. However, the film 9 may also be formed of a metal base material, to which the wirelike bodies 34, formed, for example, of an even more abrasion-proof metal, are joined. In the case of the film 9 shown in FIG. 6, the wirelike bodies 34 embedded in the elastic base material are held by form-locking engagement. In this regard, it is noted that a form-locking connection connects two elements together due to the shape of the elements themselves, as opposed to a force-locking connection, that locks the elements together by force external to the elements. The wirelike bodies 34 are flush in the same plane with the surface of the film 9 facing towards the ink roller 2. This is also true for the film shown in FIG. 7.

In FIG. 7, a further preferred embodiment of the film 9 is shown, in which the film 9 is multilayered. The wirelike bodies 34 resting on the substrate layer 28 are secured on the substrate layer 28 with a securing layer 30 that can be poured into spaces between the wirelike bodies 34. The poured-in securing layer 30 that closes up the spaces or channels between the wirelike bodies 34 is a filling-compound layer that is still liquid when poured and that cures after being poured. The wirelike bodies 34 can be held on the substrate layer by a form-lock of the pourable securing layer 30 that sheathes the wirelike bodies 34 and/or by an adhesive action of the pourable securing layer 30. The cross section of the wirelike bodies 34 is polygonal and, more specifically, rectangular, in this particular case.

Figure 8:
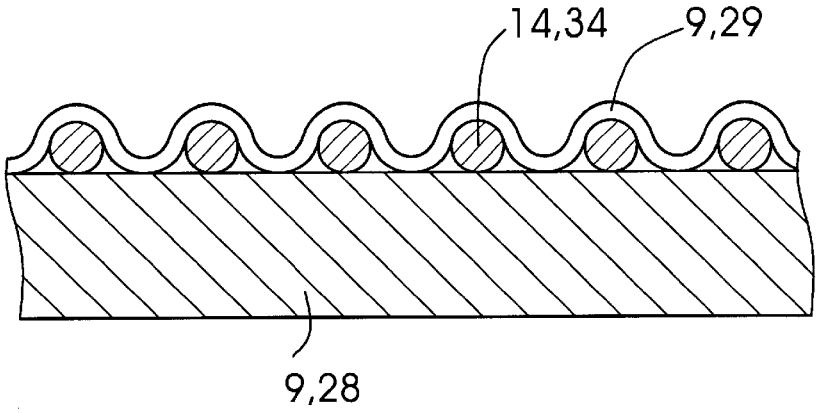
FIG. 8 is a view like those of FIGS. 6 and 7 of a further preferred embodiment of the film.

In FIG. 8, a further preferred embodiment of the film 9 is shown, in which again the film 9 is multilayered and the wirelike bodies 34 are secured on the substrate layer 28 with a film-like covering and securing layer 29, respectively. For example, this film 9 can be produced by forming the substrate layer 28 and/or the securing layer 29 as self-adhesive films, which are adhesively secured together, thereby enclosing the wirelike bodies 34 therebetween.

Figure 9:
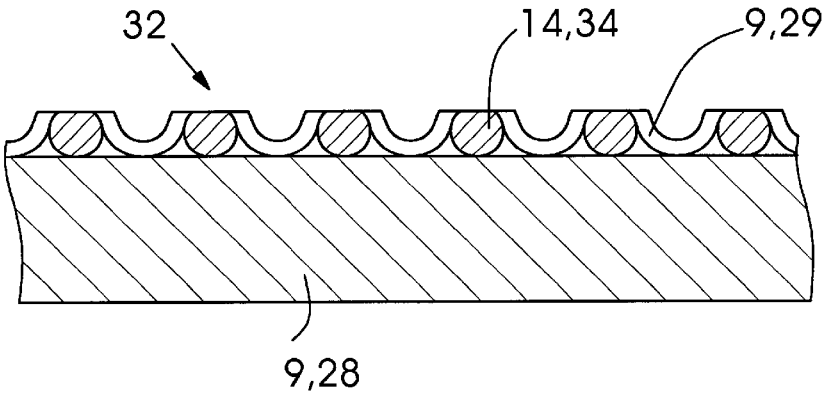
FIG. 9 is a view like that of FIG. 8 showing the film therein formed with flattened areas.

In FIG. 9, the film shown in FIG. 8 is shown again with slight modifications. The film-like securing layer 29 that covers the wirelike bodies 34 is subject to increased wear, caused by the ink roller 2. It is therefore advantageous for the film-like securing layer 29, on the one hand, to be so thin that wear of the securing layer 29, which results in a partial removal of the securing layer 29 via the wirelike body 34, has no effect upon the metering accuracy of the metering device 5. On the other hand, the securing layer 29 can already during production be removed again at those locations, for example, by regrinding. In this way, changes in the spacing of the metering elements 6 from the ink roller 2 caused by possible wear of the securing layer 29 are reliably prevented. Wirelike bodies 34 with a curved contoured profile, such as the wirelike bodies 34 of circular profile shown in FIGS. 8 and 9, can also be formed with flattened regions 32 at a side thereof facing towards the ink roller 2, for example, by regrinding; as a result, linear contact between the wirelike bodies 34 and the ink roller 2, which otherwise promotes rapid wear, is avoided and area-contact is attained.

In both the embodiment shown in FIG. 7 and the embodiments shown in FIGS. 8 and 9, the securing layer 29 or 30 may be thinner than the substrate layer 28. The securing layers 29 and 30 may be formed, respectively, of a different material than that of the appertaining substrate layers 28. Both the film-like securing layer 29 and the pourable securing layer 30 are preferably elastic. Preferably, the substrate layer 28 is elastic, as well. In the embodiments shown in FIGS. 8 and 9, the film thickness of the securing layer 29 is preferably thinner than the respective diameter and cross-sectional dimension of the wirelike bodies 34 measured perpendicularly to the axis of rotation of the ink roller 2.

In FIGS. 10 and 11, it is also shown that a diameter of circularly profiled wirelike bodies 34 is preferably less than the support width SB of the support rib 8.

In wirelike bodies 34 having a cross section other than circular, the cross-sectional dimension, measured in the direction of the film width and in the axial direction of the ink roller 2, respectively, is preferably less than the support width of the support rib 8.

I claim:

1. An ink-metering device in a printing press having a film disposed between an ink roller and metering elements associated with the ink roller, each of the metering elements having at least one support rib indirectly resting on the ink roller via the film, comprising low-wear zones provided on the film for covering the support ribs, said low-wear zones being joined in a preformed state as wirelike bodies to the film.

2. The ink-metering device according to claim 1, wherein the film has a multilayered construction.

3. The ink-metering device according to claim 2, wherein the film has a substrate layer and a filmlike securing layer, said wirelike bodies being secured on said substrate layer of the film by said securing layer of the film.

4. The ink-metering device according to claim 2, wherein the film has a substrate layer and a securing layer, said wirelike bodies being secured on said substrate layer of the film by said securing layer, said securing layer being pourable into spaces between said wirelike bodies.

5. The ink-metering device according to claim 1, wherein said wirelike bodies are embedded in solidifiable material forming the film.

6. A printing press having at least one ink-metering device according to claim 1.

7. An ink-metering device in a printing press having a film with a width disposed between an ink roller and metering elements associated with the ink roller, each of the metering elements having at least one support rib indirectly resting on the ink roller via the film, comprising low-wear zones provided on the film for covering the support ribs, said low-wear zones being joined in a preformed state as wirelike bodies to the film, said wirelike bodies having a curved contoured profile.

8. An ink-metering device in a printing press having a film disposed between an ink roller and metering elements associated with the ink roller, each of the metering elements having at least one support rib indirectly resting on the ink roller via the film, comprising a plurality of low-wear zones provided on the film for covering the support ribs, said plurality of low-wear zones being disposed so that a zonal spacing between adjacent low-wear zones is less than a total width that includes two support widths of adjacent support ribs.

9. The ink-metering device according to claim 7, wherein all of said low-wear zones of the film are disposed at an identical spacing from one another.

10. A printing press having at least one ink-metering device according to claim 7.

11. An ink-metering device in a printing press having a film disposed between an ink roller and metering elements associated with the ink roller, each of the metering elements having at least one support rib indirectly resting on the ink roller via the film, comprising a plurality of low-wear zones provided on the film, with each of said support ribs being covered by a plurality of said low-wear zones.

12. The ink-metering device according to claim 8, wherein all of said low-wear zones of the film are disposed at an identical spacing from one another.

13. A printing press having at least one ink-metering device according to claim 8.

14. An ink-metering device in a printing press having a film disposed between an ink roller and metering elements associated with the ink roller, each of the metering elements having at least one support rib with a support width indirectly resting on the ink roller via the film, comprising a plurality of low-wear zones provided on the film, with each of said at least one support rib being covered by a plurality of said low-wear zones, the support width of each of said at least one support rib being at least as large as a center-to-center spacing between two adjacent low-wear zones.

15. An ink-metering device in a printing press having a film with a width disposed between an ink roller and metering elements associated with the ink roller, each of the metering elements having at least one support rib indirectly resting on the ink roller via the film, comprising low-wear zones provided on the film for covering the support ribs, said low-wear zones being joined in a preformed state as wirelike bodies to the film and wherein all of said low-wear zones of the film being spaced equally from each respective adjacent low-wear zone throughout the width of the film.

* * * * *